United States Patent [19]

Satoh et al.

[11] Patent Number: 4,576,657

[45] Date of Patent: Mar. 18, 1986

[54] PROCESS OF MANUFACTURING A COLD ROLLED STEEL SHEET HAVING EXCELLENT PRESS FORMABILITY

[75] Inventors: Susumu Satoh, Chiba; Osamu Hashimoto, Kurashiki; Toshio Irie, Chiba, all of Japan

[73] Assignee: Kawasaki Steel Corporation, Kobe, Japan

[21] Appl. No.: 765,557

[22] PCT Filed: Feb. 18, 1983

[86] PCT No.: PCT/JP83/00050

§ 371 Date: Oct. 13, 1983

§ 102(e) Date: Oct. 13, 1983

[87] PCT Pub. No.: WO83/02957

PCT Pub. Date: Sep. 1, 1983

Related U.S. Application Data

[63] Continuation of Ser. No. 545,396, Oct. 13, 1983, abandoned.

[30] Foreign Application Priority Data

Feb. 19, 1982 [JP] Japan ..... 57-25567

[51] Int. Cl.[4] ..... C21D 9/48

[52] U.S. Cl. ..... 148/12 C

[58] Field of Search ..... 148/12 C

[56] References Cited

U.S. PATENT DOCUMENTS 3,879,232 4/1975 Gondo et al. ..... 148/12 C

FOREIGN PATENT DOCUMENTS 0045958 8/1981 European Pat. Off. .
64616 6/1978 Japan ..... 148/12 C
56-169752 12/1981 Japan ..... 148/12 C
166331 12/1981 Japan ..... 148/12 C
13123 1/1982 Japan .
57-29555 2/1982 Japan ..... 148/12 C

*Primary Examiner*—Wayland Stallard
*Attorney, Agent, or Firm*—Balogh, Osann, Kramer, Dvorak, Genova & Traub

[57] ABSTRACT

Based on the investigation as to the correlative relationship between the composition of a steel material, particularly the content of carbon and a soaking temperature for the hot rolling, the improvements of the stretch formability, deep-drawability and aging resistance of the cold rolled steel sheet and the peculiar behaviors of the effective additive ingredients under the above correlative relationship, a cold rolled steel sheet having excellent press-formability is obtained by soaking at 800°-1,100° C., a steel slab consisting of not more than 1.2% by weight of Si, 0.05-1.00% by weight of Mn, not more than 0.150% by weight of P, at least one of elements selected from the group consisting of Nb, Cr, Ti, Al, B and W in a total amount of 0.002-0.150% by weight in an extremely low range of not more than 0.005% by weight of C, followed by ordinary hot rolling, cold rolling and recrystallization annealing.

4 Claims, 4 Drawing Figures

PROCESS OF MANUFACTURING A COLD ROLLED STEEL SHEET HAVING EXCELLENT PRESS FORMABILITY

This application is a continuation of application Ser. No. 545,396, filed Oct. 13, 1983, and now abandoned.

TECHNICAL FIELD

This invention belongs to the technical field concerned with a process of manufacturing a cold rolled steel sheet having excellent press-formability.

BACKGROUND ART

In general, the cold rolled steel sheets for press forming which are used for outer plates of automobiles, gasoline tank and the like are required to be excellent in stretch formability, deep-drawability and aging resistance.

The lower the yield strength (YS) and the higher the elongation (EL) and the work hardening exponent (n value) as the material properties, the more excellent the stretch formability of the steel sheets.

The deep-drawability in the material properties is almost dominated by the Lankford value (r value). The higher the r value, the higher the limit of the deep-drawability.

On the other hand, it has been known that when there remain C,N in a solid solution state in the steel sheet, the trouble called "stretcher strain" occurs upon working of press forming due to aging at room temperature. This necessitates the aging resistance, which is ordinarily evaluated by using the aging index (AI). This index is represented by the difference between the yield strength at 7.5% preliminary strain and the yield strength after heat treatment of 100° C.×30 minutes. The steel sheets for use in press working are required to have the AI value of not more than 3 kg/mm$^2$.

There have been heretofore proposed many processes of manufacturing the cold rolled steel sheets which are excellent in the above described stretch formability, deep-drawability, and aging resistance. For instance, there is a method of box annealing a low-carbon aluminum-killed steel having a carbon content of about 0.04% by weight (the amounts of the steel ingredients being hereinafter referred to briefly as "%"); and a method of box annealing or continuously annealing a steel sheet in which a carbonitride-forming element such as Ti, Nb or the like is added into the extremely low-carbon steel having a carbon content of not more than 0.1%.

However, these conventional processes have the common feature that the temperature (hereinafter referred to as "soaking temperature") at which steel slabs are uniformly heated prior to the hot rolling is extremely high near 1,200° C.

The reason why the soaking temperature is so high is as follows: In the case of the low-carbon aluminum-killed steels, it is necessary to completely solid-solve AlN when soaking the steel slabs in order to obtain a high r value by the action of AlN precipitated upon box annealing after the cold rolling. Meanwhile, in the case of the extremely low-carbon steel to which are added Ti or Nb, since the $Ar_3$ transformation point at which the austenite phase is transformed into the ferrite phase is extremely high near 900° C., the hot roll-finishing temperature (FDT) must be high so as to avoid deterioration of the material properties due to the hot rolling at a temperature lower than the $Ar_3$ transformation temperature.

But, for heating the steel slab at a high temperature of about 1,200° C., a huge energy is not only required but also the higher soaking temperature decreases the yield of the steel slab (due to the surface oxidation), and further promotes the interior oxidization in the vicinity of the surface of the steel slab, so that such a method has the drawback that the trouble such as the surface defect, the surface hardening and the like frequently occur.

As mentioned above, the heating of the steel slab at high temperature leads to not only the consumption of much energy but also the surface defect and therefore there is strongly desired to establish the process of manufacturing the cold rolled steel sheets which lowers the soaking temperature of the steel slab and gives the excellent press-formability.

There have been proposed several processes for manufacturing the cold rolled steel in which the soaking is carried out at a low temperature of not higher than 1,200° C., followed by hot rolling, for instance, Japanese Patent Laid Open Application No. Sho 49-129,622 (Japanese Patent Application No. Sho 48-43,856), Japanese Patent Laid Open Application No. Sho 51-59,008 (Japanese Patent Application No. Sho 49-132,622) and Japanese Patent Laid Open Application No. Sho 55-58,333 (Japanese Patent Application No. Sho 53-129,071). However, in any case, in order to make the hot roll-finishing temperature to be not lower than the $Ar_3$ transformation point, the soaking temperature must be actually not lower than 1,100° C. and in the very recent Japanese Patent Laid Open Application No. Sho 57-13,123 (Japanese Patent Application No. Sho 55-84,696), the soaking temperature of the steel slab is 1,100°–1,250° C.

To the contrary, in the low-temperature soaking in which the lower limit is 1,100° C., the above described effects for saving energy and avoiding the decrease in the yield are suppressed to an extremely small degree and the material properties of the cold rolled steel sheets are not sufficiently improved as described hereinafter.

In addition to the above, Japanese Patent Laid Open Application No. Sho 53-64,616 (Japanese Patent Application No. Sho 51-140,532) discloses a process of manufacturing a steel sheet having an r value of 1.17–1.20 in which a rimmed steel slab having C of 0.05–0.11% is soaked at 980°–1,050° C., and finished at a temperature of 710°–750° C. Japanese Patent Laid Open Application No. Sho 56-15,882 (Japanese Patent Application No. Sho 55-60,713) discloses a process of manufacturing a steel sheet having an r value of 1.1 in which a steel slab having C of 0.03% and Al of 0.05% is soaked at 950° C. and finished at a temperature of 750° C. However, they both relate to the manufacture of the steel sheets having an r value being as low as not more than 1.2 and essentially differ from the deep-drawing steel sheet aimed at by the invention.

DISCLOSURE OF INVENTION

An object of the invention is to provide a process of manufacturing a cold rolled steel sheet having excellent press-formability which overcomes the above described drawbacks in the prior art in the production of the cold rolled steel sheet for press working, and enables the treatment at a temperature of 800°–1,100° C., which is far lower than that of the prior art.

The principal constitution of the invention is as follows: That is, the invention relates to a process of manufacturing a cold rolled steel sheet having an excellent press-formability in which a steel slab comprising not more than 0.005% of C, not more than 1.20% of Si, 0.05–1.00% of Mn, not more than 0.15% of P, a total amount of at least one element selected from the group consisting of Nb, Cr, Ti, Al, B and W being 0.002–0.15%, and the balance being Fe and incidental impurities is subjected to a soaking treatment at a temperature range of 800°–1,100° C., and hot rolled and succeedingly cold rolled and annealed for recrystallization.

BEST MODE OF CARRYING OUT INVENTION

Figure 1:
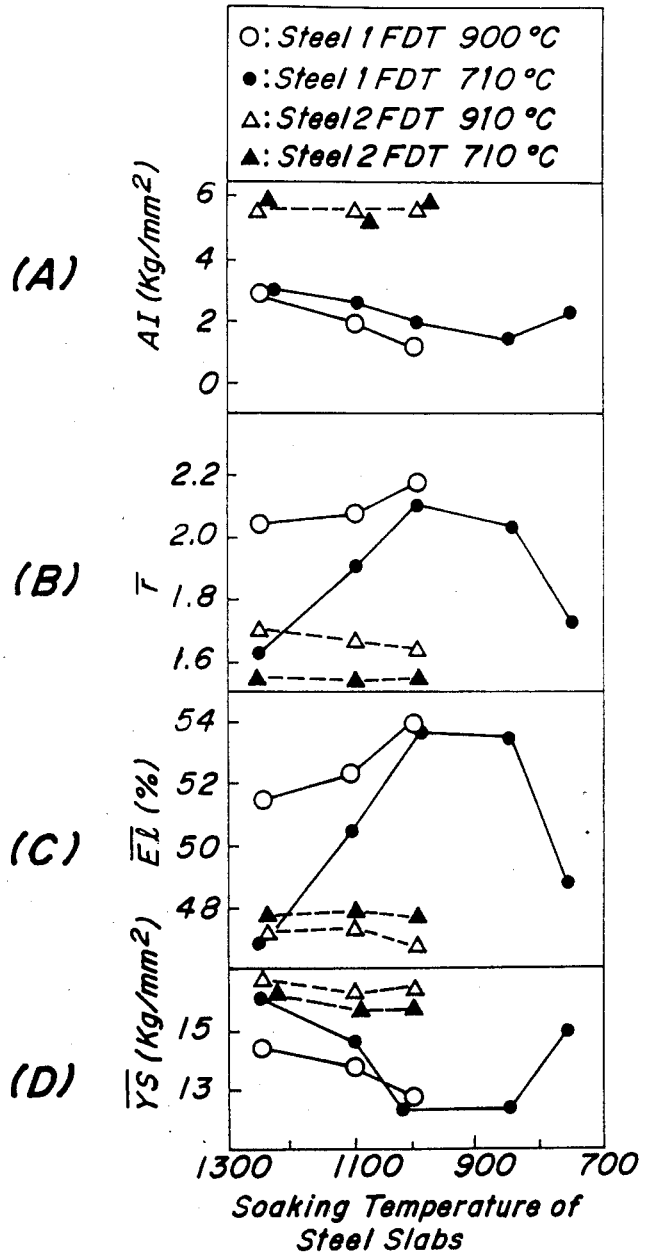
FIGS. 1 (A), (B), (C), and (D) are correlation views showing the influences of varied soaking temperatures of steel slabs in fundamental experiments for accomplishing the present invention upon an aging index (AI), an $\bar{r}$ value, an elongation (El), and a yield strength (YS).

First, the fundamental experiments made by the inventors will be explained.

Two kinds of steel slabs having the compositions as shown in Table 1 were prepared by continuously casting molten iron obtained through a bottom-blown converter and an RH degassing furnace.

TABLE 1

| Steel sample | Chemical composition (weight %) | | | | | | | |
|---|---|---|---|---|---|---|---|---|
| No. | C | Si | Mn | P | S | N | Al | Nb |
| 1 | 0.0022 | 0.012 | 0.12 | 0.012 | 0.006 | 0.0025 | 0.032 | 0.008 |
| 2 | 0.0061 | 0.010 | 0.13 | 0.010 | 0.005 | 0.0033 | 0.021 | 0.011 |

After the above two kinds of the steel slabs were once left to be cooled to room temperature, and then soaked in a soaking pit.

The soaking temperature was varied over a range of 750°–1,250° C., and the soaked steel slabs were hot rolled by means of a rougher consisting of 4 row rolls, and passed to a hot finisher consisting of 7 row rolls at two hot roll-finishing temperatures (FDT) of about 900° C. and about 710° C., and coiled as steel strips having a thickness of 3.2 mm at a constant temperature of about 500° C.

The hot rolled steel strips were pickled and cold rolled into cold rolled sheets having a thickness of 0.8 mm and then maintained at a temperature of 800° C. through continuous annealing and skin-pass rolled finally at a reduction rate of 0.6% to obtain test samples.

The influences upon the material properties of the test samples due to the differences in the soaking temperatures of the steel slabs are shown in FIGS. 1 (A), (B), (C), and (D). In the measurements of the material properties of the test samples, the tensile strength and the aging index (AI) were determined respectively using a tensile test piece of JIS Z 22015 and a test piece taken in a rolling direction, and the r value, the elongation and the yield strength were expressed by the average value of three directions, i.e., a rolling direction, and 45° and 90° directions to the rolling.

As seen from the measured results in FIG. 1, there is substantially no correlation in the test steel sample No. 2 having the carbon content of 0.0061% shown in Table 1 between the soaking temperature within the temperature range of 1,000°–1,250° C. and the material properties of the cold rolled-annealed sheet, and the r value of the low FDT steel is low. On the other hand, it has been found that the properties of the test steel sample No. 1 having C of 0.0022% strongly depends upon the soaking temperature of the steel slab. More specifically, when the results in the case of a hot roll-finishing temperature (FDT) of 900° C. represented by the mark "o" are noticed, as the soaking temperature lowers as from 1,250° C. to 1,100° C., and 1,000° C., the elongation and the $\bar{r}$ value increased and the aging index (AI) and the yield strength (YS) lower and this indicates that the press-formability is conspicously improved.

Meanwhile, when the measured results at the hot roll-finishing temperature (FDT) being 710° C. expressed by the mark "•", are noticed, the material properties in the case of the soaking temperature being higher than 1,100° C., are fairly inferior to those in the case of the soaking temperature being 900° C. However, when the soaking temperature of the steel slab is not higher than 1,100° C., the material properties become very excellent as in those when the hot roll-finishing temperature is 900° C. However, when the soaking temperature is as low as lower than 800° C., it is apparent that the material properties are rapidly deteriorated.

This is an extremely important discovery. In the conventional process of manufacturing the cold rolled steel sheets for press forming, it has been common knowledge that the hot roll-finishing should not be effected at a temperature of lower than the $Ar_3$ transformation point at which the steel is transformed from the $\gamma$-phase to $\alpha$-phase, because such heat treatment causes the remarkable deterioration of the material properties. However, the $Ar_3$ transformation point of the test steel No. 1 used in the above test by the inventors is about 830° C., and therefore the above test results completely break the conventional common knowledge.

The phenomenon observed in the test steel No. 1 in the experimental results shown in FIG. 1 is caused by setting the soaking temperature of the steel slab to a far lower range of 800°–1,100° C. than that of the conventional processes. For this reason, according to the invention, the soaking temperature of the steel slab for the hot rolling is limited to a range of 800°–1,100° C. Based on the results of this fundamental experiment, the inventors have repeated the same experiment for confirming the effect of soaking of the steel slab at the low temperature with respect to a variety of steel slabs having different compositions from the test steel No. 1 and confirmed that the effect of the low temperature soaking is more improved by limiting the steel components as follows and that cold rolled steel sheets having excellent formability can be obtained.

C: not more than 0.005%

As seen from the properties of the test steel No. 2 having C of 0.0061% shown in FIG. 1, the effect in the low-temperature soaking disappears if the carbon content exceeds 0.005%. Thus, the carbon content is limited to not more than 0.005%, preferably not more than 0.004%.

Si: not more than 1.20%

Si is an element effective for strengthening the steel. However, if it exceeds 1.2%, the hardness is conspicuously increased and the elongation lowers and the yield strength is raised. Thus, it is limited to not more than 1.20%.

Mn: 0.05–1.00%

At least 0.05% of Mn is required to prevent the red shortness due to S, but if it exceeds 1.00%, it damages the ductility of the steel similarly to Si. Thus, the content of Mn is limited to a range of 0.05–1.00%.

P: not more than 0.150%

P is high in the ability for strengthening the steel due to formation of solid solution and is an element having activity for increasing the strength but if it exceeds 0.150%, it brings about conspicuous deterioration of the spot weldability. Thus, the content of P is limited to not more than 0.150%. Nb, Cr, Ti, Al, B and W: Total amount of at least one of these elements being 0.002–0.150%.

These elements are important in the invention. The function and effects of these elements are considered as follows:

(1) Any of these elements is a carbide, nitride or sulfide-forming element and when the steel slab is soaked at 800°–1,100° C. according to the invention, the forms of these precipitates extremely effectively influence the press-formability of the final product.

(2) Apart from the effect based on the formation of the above precipitates, these elements behave similarly in view of the extremely great influence upon formation of micro-crystal grains and improvement of the texture when soaking the steel slab in the solid solution state.

These additive elements have been heretofore widely used for the improvement of the properties of the iron steel materials, but it has been considered that the addition effects varies depending upon their addition amounts and the combined addition with other elements, and also depend greatly upon the chemical compositions of the base steels. However, it has been found that these additive elements serve very effectively to improve the formability of the cold rolled steel sheets which have been subjected to the soaking treatment at a low temperature of 800°–1,100° C. only in the case of an extremely low-carbon steel having a carbon content of not more than 0.005%, and that the functional effect is substantially equivalent in any elements. Therefore, these elements may be added alone or in a combination of two or more elements. If the total addition amount is less than 0.002%, no effect is observed, while if it exceeds 0.150%, the effect is not increased in proportion to the increased amount and the ductibity is adversely affected due to the hardening of the solid solution, so that the total addition amount is limited to a range of 0.002–0.150%. The optimum addition amount and combination of these elements slightly differ depending upon the elements. Particularly, in the case of Nb or W, Al is within a range of 0.005–0.08%, and in a combination of Nb and W, any of the total amount or the single element amount is preferred to be a range of 0.002–0.020%. When at least two elements of Cr, Ti, B and Al are selected, the total amount thereof is optimum in the range of 0.002–0.090%.

The reason of the limitation on the elements in the steel according to the invention has been explained but the balance consists of iron and incidental impurities besides the above elements.

Explanation will be made with respect to the steps for producing the cold rolled steel sheets having the above described composition wherein the present invention is applied.

The steel making process is not particularly limited but the combination of a converter and a degassing furnace is more effective in order to suppress the content of carbon to not more than 0.005%.

The process of manufacturing the steel slab may be the conventional slabbing, that is ingot making-blooming method or a continuous casting method.

With respect to the heating of the steel slab, it is important to soak it at a temperature range of 800°–1,100° C. If the soaking can be carried out within this temperature range, the method and apparatus for heating the slab are not limited and the temperature of the steel slab prior to the soaking is arbitrary. Accordingly, the steel slab may be one completely cooled to room temperature or one having a temperature higher than room temperature and it is merely necessary to soak the slab at a temperature range of 800°–1,100° C. by reheating. The soaking time is not particularly limited and if the entire steel slab is heated to the soaking temperature of 800°–1,100° C., the object can be attained but the soaking time is preferred to be from 10 minutes to one hour.

Therefore, with respect to the steel slab manufactured by the continuous casting, when the temperature of the steel slab is not lower than 800° C., it is unnecessary to once cool and reheat, but it is merely necessary to keep the temperature at a temperature range of 800°–1,100° C. or to gradually cool the slab to this temperature range. Therefore, no particularly heating furnace is necessary in the case of the steel slab obtained by the continuous casting, and it is possible to attain the satisfactory effects only by regulating the cooling speed.

In the hot rolling of the thus soaked steel slab, no adverse effect takes place on the material properties of the final cold rolled steel sheet so long as the rolling conditions such as rolling speed, rolling reduction, distribution of reduction in rolling, roll-finishing temperature and coiling temperature and the like are within the usual ranges.

However, if the finishing temperature in the hot rolling is too low, the deformation resistance becomes high to make the rolling difficult, so that it is preferable to be higher than 550° C. Further, since the surface oxidized layer of the hot rolled steel strip formed until coiling after the finish rolling highly influences the surface profile of the final cold rolled steel sheet, the finishing temperature is preferred to be as low as possible. Therefor, the finishing temperature is preferably 550°–850° C. Since the steel containing an element or elements other than Nb and W is very low in the deformation resistance in the ferrite region, the finishing temperature may be lower than that of the steel to which Nb or W is added, and the temperature is preferred to be 550°–680° C.

On the other hand, the temperature for coiling the hot rolled steel sheet is preferred to be a range of 400°–600° C., because as said temperature is lower, the pickling ability is improved and the pickling cost is reduced and the good surface profile can be ensured, so that the temperature is preferred to be 400°–600° C.

The reduction in the cold rolling is preferred to be 50–95%.

The recrystallization annealing may be carried out by any process of a box annealing using a bell furnace and a continuous annealing of a rapid heating type, but the continuous annealing is more preferable in view of the productivity and the uniformity of the material quality. The annealing temperature is preferably in a range of 650°–850° C.

Meanwhile, the cooling speed after the soaking, or presence or absence of the over aging treatment in the case of continuous annealing has no substantial influence upon the present invention.

In order to correct the profile of the cold rolled steel sheet after annealing, a tempering rolling may be additionally conducted under a reduction rate of not more than 1.5% through a skinpass.

EXAMPLE

With respect to the compositions shown in Table 2 satisfying the requirements of the invention, molten iron was produced by means of a bottom-blown converter and an RH degassing furnace and then continuously cast or ingot-made and then bloomed to produce a steel slab.

The steel slabs thus obtained were subjected to soaking treatments at a temperature range of 850°–1,080° C. prior to the soaking was different and 20°–1,100° C. as shown in this Table.

The thus soaked steel slabs were hot rolled at a hot roll-finishing temperature of 620°–850° C., and a hot roll-coiling temperature of 320°–550° C. to obtain hot rolled sheets each having a thickness of 2.8–3.2 mm. Then, the hot rolled sheets were cold rolled to cold rolled sheets each having a thickness of 0.8 mm, and as indicated in Table 3, they were subjected to the recrystallization annealing in a continuous annealing furnace at a uniform temperature of 760°–800° C. All the annealed test sample sheets were treated by a skinpass to obtain the final products.

The average properties of the final product in the rolling direction, and in the directions of 45° and 90° to the rolling are shown in Table 4.

TABLE 2

| Test Sample Steel No. | Chemical Composition (wt %) | | | | | | | | | | | |
|---|---|---|---|---|---|---|---|---|---|---|---|---|
| | C | Si | Mn | P | S | N | Nb | Cr | Ti | Al | B | W |
| A | 0.0013 | 0.02 | 0.15 | 0.01 | 0.008 | 0.004 | 0.006 | — | — | 0.041 | — | — |
| B | 0.0024 | 0.02 | 0.15 | 0.08 | 0.006 | 0.003 | 0.004 | — | — | 0.025 | — | — |
| C | 0.0032 | 0.02 | 0.15 | 0.01 | 0.008 | 0.004 | — | 0.046 | — | 0.035 | — | — |
| D | 0.0027 | 0.02 | 0.13 | 0.01 | 0.008 | 0.002 | — | 0.070 | — | 0.063 | — | — |
| E | 0.0032 | 0.02 | 0.15 | 0.01 | 0.005 | 0.002 | — | — | 0.036 | — | — | — |
| F | 0.0012 | 0.02 | 0.18 | 0.01 | 0.011 | 0.005 | — | — | — | — | 0.0052 | — |
| G | 0.0025 | 0.90 | 0.15 | 0.01 | 0.009 | 0.003 | — | — | — | 0.024 | — | 0.004 |
| H | 0.0010 | 0.02 | 0.15 | 0.01 | 0.007 | 0.001 | — | — | — | 0.056 | — | — |
| I | 0.0008 | 0.02 | 0.15 | 0.09 | 0.008 | 0.003 | — | — | — | 0.028 | 0.0035 | — |
| J | 0.0027 | 0.02 | 0.15 | 0.01 | 0.008 | 0.004 | 0.002 | — | 0.020 | — | — | — |
| K | 0.0046 | 0.02 | 0.70 | 0.07 | 0.008 | 0.004 | — | 0.052 | 0.025 | — | — | — |
| L | 0.0023 | 0.03 | 0.20 | 0.05 | 0.007 | 0.003 | — | — | 0.052 | 0.016 | — | — |

TABLE 3

| Test sample steel | Process for manufacturing steel slab | Steel slab temperature prior to being charged into soaking pit (°C.) | Soaking temperature of steel slab (°C.) | Hot rolling | | Annealing conditions | |
|---|---|---|---|---|---|---|---|
| | | | | Finishing temperature (°C.) | Coiling temperature (°C.) | Method | Temperature (°C.) |
| A | continuous casting | 20 | 1080 | 780 | 550 | continuous | 800 |
| B | continuous casting | 1100 | 1100~1060 | 880 | 500 | " | 760 |
| C | continuous casting | 22 | 850 | 630 | 420 | " | 800 |
| D | ingot making-blooming | 23 | 1020 | 780 | 550 | " | 760 |
| E | continuous casting | 450 | 1030 | 660 | 520 | " | 800 |
| F | continuous casting | 850 | 950 | 650 | 380 | " | 770 |
| G | continuous casting | 380 | 1020 | 650 | 400 | " | 800 |
| H | continuous casting | 25 | 1000 | 670 | 510 | " | 800 |
| I | continuous casting | 25 | 950 | 620 | 470 | " | 800 |
| J | continuous casting | 870 | 860 | 650 | 320 | " | 770 |
| K | continuous casting | 520 | 1020 | 850 | 550 | " | 800 |
| L | continuous casting | 20 | 1050 | 660 | 530 | " | 780 |

as shown in Table 3. The temperature of the steel slab

TABLE 4

| Test sample steel | Yield strength ($kg/mm^2$) | Tensile strength ($kg/mm^2$) | Elongation (%) | $\bar{r}$ value | Aging Index AI value ($kg/mm^2$) | n value* |
|---|---|---|---|---|---|---|
| A | 13 | 29 | 54 | 2.0 | 1.2 | 0.31 |
| B | 21 | 37 | 44 | 1.9 | 1.6 | 0.26 |
| C | 14 | 28 | 53 | 1.8 | 2.4 | 0.29 |
| D | 14 | 29 | 52 | 2.0 | 1.5 | 0.28 |
| E | 15 | 29 | 51 | 2.1 | 0.4 | 0.31 |
| F | 13 | 28 | 54 | 1.7 | 2.0 | 0.30 |

TABLE 4-continued

| Test sample steel | Yield strength ($kg/mm^2$) | Tensile strength ($kg/mm^2$) | Elongation (%) | $\bar{r}$ value | Aging Index AI value ($kg/mm^2$) | n value* |
|---|---|---|---|---|---|---|
| G | 22 | 36 | 43 | 1.8 | 0.3 | 0.25 |
| H | 14 | 27 | 51 | 1.8 | 1.0 | 0.28 |
| I | 19 | 36 | 43 | 1.8 | 0.8 | 0.27 |
| J | 14 | 29 | 53 | 2.2 | 1.0 | 0.29 |
| K | 25 | 42 | 38 | 1.7 | 1.5 | 0.25 |
| L | 18 | 32 | 47 | 1.8 | 0.5 | 0.27 |

Note: *n values at 10% and 20% of deformations.

As seen from the property values of the materials shown in Table 4, the tensile strengths depend upon the compositions of the test sample steels and the test sample steels B, G, I, and K show the values of not less than 35 $kg/mm^2$ and the other samples are not more than 32 $kg/mm^2$, but any sample steels are low in the yield strength and high in both the elongation, $\bar{r}$ value and n value, and show the aging index (AI) of not more than 3 $kg/mm^2$. This indicates that all samples A–L are cold rolled steel sheets having excellent stretch formability, deep-drawability and aging resistance.

The steel slabs shown in the above Example are ones having a thickness of about 100–250 mm which are produced by the ingot making-blooming method or a continuous casting method but the invention is obviously applicable to a sheet bar having a thickness of 20–60 mm produced directly from the molten steel through a sheet bar caster.

That is, when the sheet bar is subjected to the hot rolling, it is merely necessary to uniformly heat the bar within a temperature range of 800°–1,100° C. or to keep the temperature at said temperature range. Further, the cold rolled steel sheets according to the invention are used effectively as raw materials for manufacturing all sorts of the surface treating steel sheets such as continuous hot-dip galvanizing steel sheets by the in-line annealing system.

According to the invention, a cold rolled steel sheet having excellent stretch formability, deep-drawability and aging resistance can be manufactured only by effecting the soaking treatment at a temperature range of 800°–1,100° C. when hot rolling a steel slab in which at least one of Nb, Cr, Ti, Al, B, and W is added in a total amount of 0.002–0.15% to an extremely low carbon steel having a carbon content of 0.005% or less without being influenced by the subsequent hot rolling and cold rolling conditions and the annealing conditions.

INDUSTRIAL APPLICABILITY

As mentioned above, the temperature range for the soaking treatment according to the invention is a low temperature range which is contrary to the conventionally common knowledge, and therefore not only a huge amount of energy consumption can be saved to a large extent, but also due to the reduction in the amount of surface oxidation, the yield and the properties of the surface and interior of the product can be largely improved.

We claim:

1. A process of manufacturing a cold rolled steel sheet having excellent press-formability, which comprises soaking a steel slab consisting of not more than 0.005% by weight of C, not more than 1.20% by weight of Si, 0.05–1.00% by weight of Mn, not more than 0.150% by weight of P, at least one element selected from the group consisting of Nb, Cr, Ti, Al, B, and W in a total amount of 0.002–0.150% by weight, and the balance being Fe and incidental impurities at a temperature range of 800°–1,080° C., followed by a hot rolling, a cold rolling, and a recrystallization annealing consecutively, whereby the resulting cold rolled steel sheet has an elongation of over 50% and an $\bar{r}$ value $\geqq 1.8$.

2. A process as claimed in claim 1, wherein the steel slab is soaked at a temperature of 800°–1,080° C., hot rolled at a finishing temperature of 550° C.-$Ar_3$, and a coiling temperature of not higher than 600° C. and successively cold rolled and continuously annealed.

3. A process of manufacturing a cold rolled steel sheet having excellent press-formability, which comprises soaking a steel slab consisting of not more than 0.004% by weight of C, not more than 1.2% by weight of Si, 0.05–1.00% by weight of Mn, not more than 0.150% by weight of P, 0.005–0.080% by weight of Al, and at least one of Nb and W in a total amount of 0.002–0.020% by weight, and the balance being Fe and incidental impurities at 800°–1,080° C., followed by a hot rolling at a finishing temperature of 550° C.-$Ar_3$ and a coiling temperature of not more than 600° C., a cold rolling and a continuous annealing, whereby the resulting cold rolled steel sheet has an elongation of over 50% and an r value $\geqq 1.8$.

4. A process of manufacturing a cold rolled steel sheet having excellent press-formability which comprises soaking a steel slab consisting of not more than 0.004% by weight of C, not more than 1.20% by weight of Si, 0.05–1.00% by weight of Mn, not more than 0.150% by weight of P, at least one element selected from the group consisting of Cr, Ti, Al and B in a total amount of 0.002–0.090% by weight, and the balance being Fe and incidental impurities at 800°–1,050° C., followed by a hot rolling at a finishing temperature of 550°–680° C. and at a coiling temperature of not more than 600° C., a cold rolling and a continuous annealing, whereby the resulting cold rolled steel sheet has an elongation of over 50% and an $\bar{r}$ value $\geqq 1.8$.

* * * * *